United States Patent [19]

O'Brian

[11] 4,371,167

[45] Feb. 1, 1983

[54] PSYCHOGRAPHS WITH SOUND PRODUCING MEMBERS

[76] Inventor: Edward D. O'Brian, 2125 W. Falmouth Ave., Anaheim, Calif. 92801

[21] Appl. No.: 164,924

[22] Filed: Jul. 1, 1980

[51] Int. Cl.³ ..... A63F 9/18

[52] U.S. Cl. ..... 273/161; 46/232; 46/239

[58] Field of Search ..... 273/161, 239, 1 M; 46/232, 236, 239, 240; 324/228

[56] References Cited

U.S. PATENT DOCUMENTS

| | | | |
|---|---|---|---|
| 446,054 | 2/1891 | Bond | 273/161 |
| 1,125,833 | 1/1915 | Fuld | 273/161 |
| 2,220,455 | 11/1940 | McCarthy | 273/161 |
| 2,619,349 | 11/1952 | Abrahamson | 273/239 X |
| 2,843,821 | 7/1958 | Gottlieb | 46/236 X |
| 3,307,850 | 3/1967 | Thomas | 273/161 |
| 3,640,537 | 2/1972 | Klamer et al. | 273/239 X |
| 3,707,290 | 12/1972 | Birkrant | 273/161 |

*Primary Examiner*—Anton O. Oechsle

[57] ABSTRACT

A psychograph including a bottom member provided with a plurality of indicia on its upper surface and a planchette or small table movable relative to the upper surface so as to successively indicate various of the indicia can be constructed so as to produce a sound when the planchette is moved into a position to indicate a specific indicia. Such sound production is accomplished by locating a permanent magnet on the planchette or within the planchette so that it is movable to actuate a tone bar or similar member located on or within the planchette. Iron or other ferromagnetic non-permanently magnetized members or permanent magnets are located on the bottom member in association with each of the indicia so as to cause movement of the permanent magnet on the planchette.

9 Claims, 5 Drawing Figures

Fig. 3
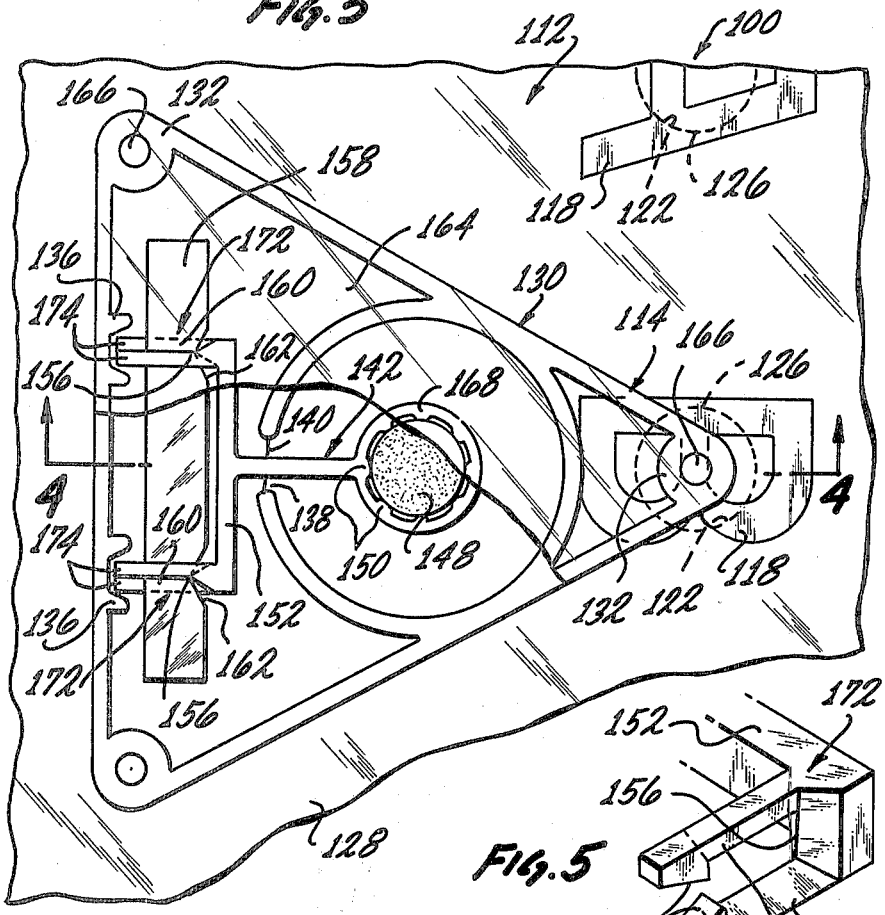
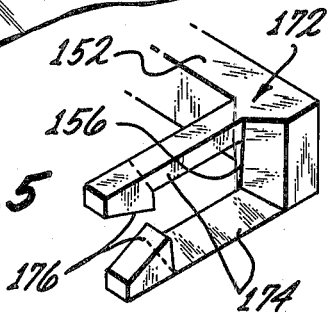
Fig. 5
Fig. 4
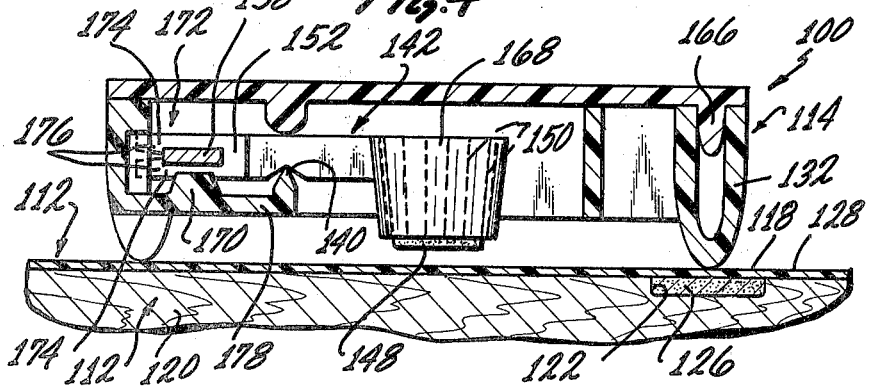

PSYCHOGRAPHS WITH SOUND PRODUCING MEMBERS

BACKGROUND OF THE INVENTION

The invention set forth in this specification pertains to new and improved psychographs. More specifically it pertains to psychographs of the type in which a planchette or small table is moved relative to the upper surface of a bottom member so as to indicate various indicia.

Unfortunately there is an absence of generally accepted generic terminology which can be used in designating psychographs of the type to which the present invention pertains. Since the term "psychograph" was used in the British Provisional Patent Specification No. 173 of 1854 to designate a device which is somewhat related to the devices of the present invention it has been used in the title of this specification even though it is not generally used.

Although devices of the type involved with the present invention are on occasion referred to as "toys" or "games" these terms are so broad as to give no indication of any specific type of structure. On occasion expressions such as "talking board", "message interpreting device", "fortune telling device", "communication board" and many others have been used to designate devices in the field of the present invention. Such designations tend to be somewhat misleading and are not considered to be generally accepted as indicating devices which are related to those of this invention.

Probably the problem of the absence of freely useable, commonly recognized generic terminology for use in indicating devices of the type involved with the present invention can be traced to social and religious attitudes with respect to these devices. The fact that it is reasonably established that they can be used in connection with the treatment of certain mental disorders by giving an indication of normally repressed thoughts and feelings within a person's subconscious does not detract from their normal association with the vaguely understood, loosely defined occult and psychic fields. Because of the ways these fields have been considered by many and because for many years there was a lack of serious investigation of these fields it is considered that adequate generic language has not been generally adopted in at least English for what are referred to in this specification as "psychographs".

During the use of psychographs of the type to which this invention pertains the planchette is located on the upper surface of the bottom member and is then normally engaged by the digits on at least one hand of at least one user. It is normally believed that if the user or users are then in a relaxed or trance-like mental state that the planchette will move as a result of noncounsciously controlled muscle movement to specific indicia so as to convey a meaning or message. Although such indica may provide an answer to a specific question in this type of psychograph more commonly this type of device is constructed so that the indicia are merely letters which have to be sequentially identified by the planchette in indicating a message or meaning.

As psychographs of the variety indicated are used the planchette is frequently moved quite rapidly from one location to another and frequently it is rather difficult to determine whether or not the planchette has or has not designated a specific indicia such as a specific letter or number. This can be rather critical to a message or communication being comprehensible or having a desired meaning. As a result of this it is considered that there is a need to improve the construction of psychographs of the type to which this invention relates so that the indicia designated during planchette movement are clearly and distinctly indicated.

SUMMARY OF THE INVENTION

The invention set forth in this specification is intended to fulfill this need. More specifically it is intended to provide new and improved psychographs which are not particularly complicated or expensive to manufacture, which may be used in the same manner as prior related psychographs, and which are reasonably effective in providing indications as to when specific indicia are indicated by the planchettes in such psychographs.

Broadly the invention is concerned with psychographs each of which includes a bottom member having an upper surface and a planchette capable of being moved relative to this surface in which the improvement comprises: a permanent magnet located on the planchette so as to be movable relative to the planchette, means capable of magnetic interaction with the permanent magnet so as to cause movement of the permanent magnet in at least one position of the planchette relative to the top surface, the means being located on the bottom member, and sound producing means located on the planchette for producing a sound in response to movement of the permanent magnet with respect to the planchette.

BRIEF DESCRIPTION OF THE DRAWINGS

Because of the nature of this invention it is best more fully explained with reference to the accompanying drawings in which:

FIG. 3 is a top plan view of a part of a modified embodiment of a psychograph in accordance with the invention in which a part of the top plate of the planchette is broken away to show internal details of the construction within the planchette;

FIG. 4 is a partial cross-sectional view taken at line 4—4 of FIG. 3; and FIG. 5 is an isometric view showing a part of the lever shown in FIGS. 3 and 4.

Figure 1:
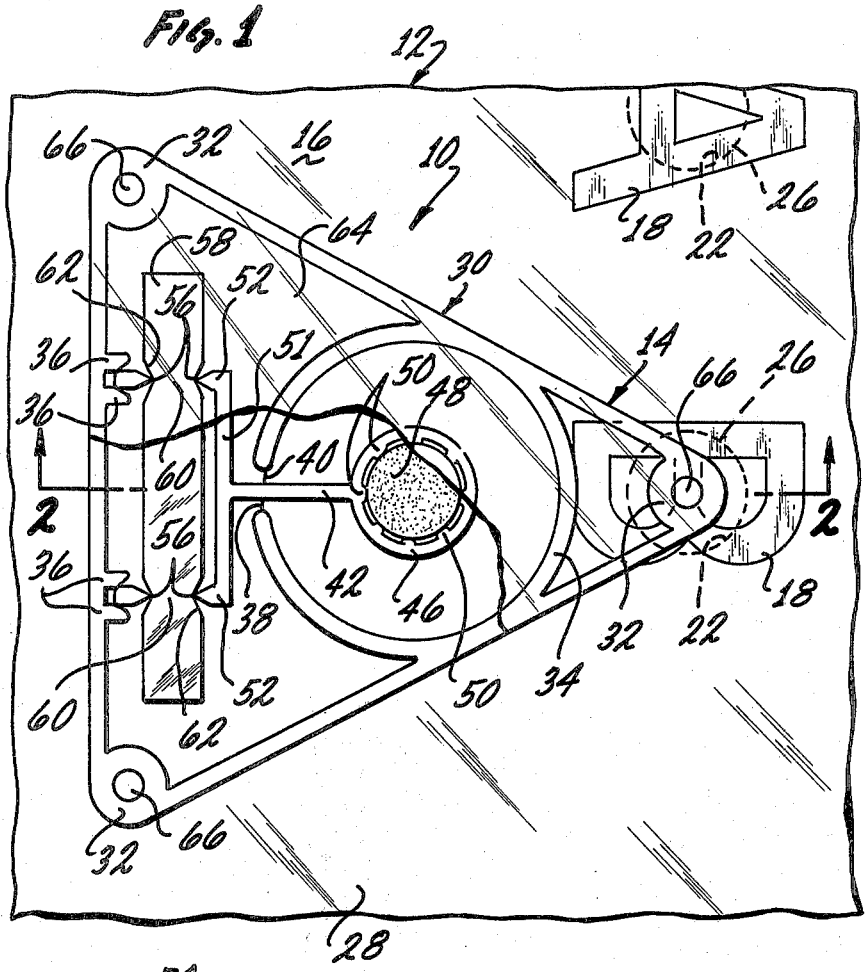
FIG. 1 is a top plan view of a part of a presently preferred embodiment of a psychograph in accordance with this invention in which a part of the top plate of the planchette is broken away so as to clearly show internal details of the construction within the planchette.
Figure 2:
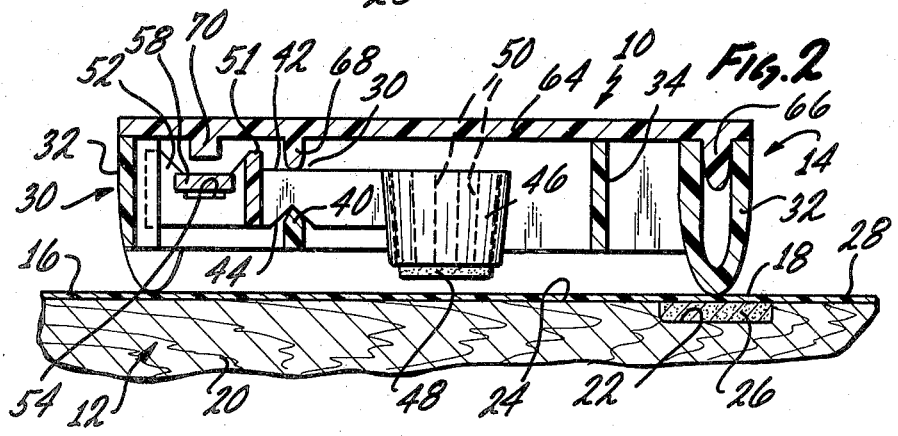
FIG. 2 is a partial cross-sectional view taken at line 2—2 of FIG. 1.

The psychographs illustrated in the drawings are constructed so as to utilize the concepts of the invention set forth and defined in the claims appended to this specification. It is believed that it will be obvious that these concepts or principles can be embodied within a variety of differently constructed and appearing psychographs through the use or exercise of routine engineering skill.

DETAILED DESCRIPTION

In FIG. 1 of the drawings there is shown a psychograph 10 in accordance with this invention which includes two principal parts of components—a support member or "board" 12 and a planchette 14—which is adapted to be moved relative to the top surface 16 of the support member 12 to positions in which individual indicia 18 of a series of such indicia 18 can be visually identified. Although it would be possible to construct the psychograph 10 in accordance with various known manners so that the planchette 14 would only be movable along a linear path or would only be moved in a restricted manner relative to a pivot point or shaft, it is constructed as hereinafter described so that the planchette 14 can be moved in an essentially random or "free" manner relative to the top surface 16.

The support member 12 illustrated includes a bottom support or "board" 20 of a nonferromagnetic material such as wood, wood fiber board, a rigid polymer or plastic or the like having a series of depressions 22 located in its upper surface 24. These depressions 22 are spaced from one another as hereinafter indicated. They contain small bodies 26 of a ferromagnetic, nonpermanently magnetized material such as "soft" iron or a ceramic composition having similar properties. These bodies 26 are preferably secured in place through the use of a conventional adhesive (not shown). It is noted that these bodies 26 are shaped so as to be flush with the surface 24.

Both the bodies 26 and the surface 24 are preferably covered by a thin, opaque coating 28 which technically provides the top surface 16. This coating 28 is also nonferromagnetic in character. It consist of a paint or paint-like composition or it may consist of a film of a polymer composition such as nylon. Preferably it is composed of a material or composition having low friction characteristics so as to facilitate movement of the planchette 14.

The various indicia 18 are preferably located on the coating 28 by conventional techniques such as printing, silk screening, or the like using a nonferromagnetic ink so that each indica 18 is associated with a single one of the bodies 26 and is located directly above it. These indicia 18 are also preferably formed of a material having low friction characteristics so as to facilitate movement of the planchette 14. Preferably they are also sufficiently thin so as to not project from the coating 28 to any significant or noticeable extent for the same reason. If desired a thin layer of a wax or wax-like composition (not shown) may be located over the entire top surface 16 to facilitate movement of the planchette 14.

So long as the bodies 26 and the indicia 18 are spaced from one another their locations on the support member 12 are essentially a matter of choice. Similarly the specific indicia 18 used are a matter of choice. On occasion it may be desired to use indicia 18 taking the form of mystical signs or specific notes of a musical scale. Normally the indicia 18 used will consist of the letters of the alphabet and a series of numbers. On occasion simple words such as "yes" or "no" capable of serving as answers to simple questions will be used as the indicia 18.

The planchette 14 includes a three-sided frame 30 the corners 32 of which are shaped as downwardly extending hollow bullets so as to be capable of serving as legs so as to support the planchette 14 on the top surface 16. Because the corners 32 serve this function it is also preferred to form the frame 30 of a polymer material having comparatively low friction characteristics in order to also facilitate planchette movement.

Preferably the frame 30 includes an internal cylinder 34 serving as an aid in the visual identification of specific indicia 18 during the use of the planchette 14. So that the cylinder 34 can adequately serve this function it is preferably larger than any of the indicia 18. Similarly to avoid confusion between adjacent indicia 18 all of the indicia should be spaced from one another a sufficient distance so that no parts of any two of the indicia 18 can be viewed through the cylinder 34 at any one time. The frame 30 also includes two sets of vertically extending, parallel guide ribs 36. A small narrow notch 38 terminating in an upwardly extending pointed bottom edge 40 serving as a fulcrum is located in the cylinder 34.

The planchette 14 also includes a lever 42 having a bottom V shaped notch 44 containing the edge 40 in such a manner as to permit limited pivoting of the lever 42. This lever 42 includes a small cylinder 46 adapted to carry a small disk shaped permanent magnet 48. Although the magnet 48 may be mounted in the cylinder 46 in many ways it is preferred to locate it in place through the use of parallel ribs 50 shaped so that the magnet 48 can be press-fitted in place in the cylinder 46 as shown. This magnet 48 is magnetically oriented so that it will be pulled downwardly so as to pivot the lever 42 whenever it is located above one of the bodies 26.

This lever 42 also includes a crossbar 50 carrying two parallel arms 52. These arms 52 are provided with flattened more or less U shaped notches 54 having pointed edges 56. These arms 52 extend to between guide ribs 36 so as to be guided by the ribs 36 during pivoting of the lever 42 so as to limit movement of the lever 42 to pivoting in a vertical plane. A tone bar 58 is shaped so as to fit with the notches 54 so that this bar 58 is supported by the arms 52. This tone bar 58 is preferably dimensioned so that its nodal regions 60 located about one-fourth of its length from its ends (not separately numbered) are located over the edges 56. Preferably other notches 62 are located at these regions 60 of the tone bar 58 so as to engage the arms 52 in order to prevent shifting of the tone bar 58 with respect to the lever 42.

The planchette 14 also includes a transparent cover 64 shaped so as to fit on and cover the frame 30. Preferably this cover 64 includes downwardly extending projections 66 capable of being press-fitted into the hollow cylinders 34 so as to mount the cover 64 on the frame 30 in such a manner as to contain the lever 42 and the tone bar 58 generally between the cover 64 and the frame 30. The cover 64 is provided with a small projection 68 which is located within the notch 38 when the cover 64 is in place. This projection 68 not only prevents movement of the lever 42 out of the bottom of the notch 38 but in addition serves to limit rotation of the lever 42 by hitting against this lever 42. The cover 64 also includes a downwardly extending, pointed striker 70 which serves a secondary function of blocking movement of the tone bar 58 out of the notches 54.

The length and weight of the lever 42 is proportioned relative to the weight and placement of the tone bar 58 and the magnet 48 so that the lever 42 is "normally" biased by gravity with the tone bar 58 spaced from the striker 70. As the planchette 14 is used and is moved across the top surface 16 this biasing permits the magnet 48 to be drawn as a result of magnetic interaction toward a body 26 when the magnet 48 is located reasonably directly above this body 26. As a result of such movement the lever 42 will be pivoted so as to bring the tone bar 58 into contact with the striker 70. This will cause the tone bar 58 to vibrate to produce a sound or tone indicating that the planchette 14 has been located with respect to the indicia 18 associated with this particular body 26. Contact of the tone bar 58 with the striker 70 until the planchette 14 is further moved will tend to dampen the sound produced.

It is noted that several different factors are involved in connection with the operation of the planchette 14 so as to produce a sound or tone as indicated in the preceding. There are the obvious factors relating to the magnetic characteristics of the magnet 48 and the bodies 26. The "normal" spacing of the magnet 48 when it is spaced from any body 26 is also important in several ways. Such spacing must be sufficiently small so as to permit the magnetic attraction described. The less the clearance between the magnet 48 and the surface 16 the more sensitive the planchette 14 is to being located relative to a body 26. Further, the weight balance of the lever 42, the magnet 48 and the tone bar 58 are important. The more closely balanced the lever 42 about the edge 40 the less the criticality of the positioning of the magnet 48 relative to a body 26 in producing a tone.

The balance of the lever 42 relative to the edge 40 is also significant in another regard. As the planchette 14 is moved so that the magnet 48 is passed over a body 26 reasonably rapidly without a pause or interruption occurring in the movement of the planchette 14 the lever 42 will not be moved so as to produce a tone. This is primarily related to the inertia of the components employed and the time required for the magnetic interaction employed to result in movement of the lever 42 to a sufficient extent necessary to produce a tone. By adjusting the balance of the lever 42 so that very little force is required to pivot it so as to produce a tone the duration of such a pause or interruption necessary to produce a tone may be decreased.

In FIG. 3 of the drawings there is shown a modified psychograph 100 in accordance with this invention which is closely related to the previously described psychograph 10. Because of the similarity between the psychographs 10 and 100 those parts of the psychograph 100 which are the same as or which are quite similar to parts of the psychograph 10 are note separately described herein and are designated when necessary for descriptive purposes in this specification and are indicated in FIGS. 3, 4 and 5 of the drawings by the same numerals previously used to identify such parts preceded by the numeral 1.

The psychograph 100 differs from the psychograph 10 in that the lever 142 in the psychograph 100 is intended to be pivoted as a result of magnetic repulsion whereas the lever 42 in the psychograph 10 is rotated as a result of magnetic attraction. In the psychograph 100 this is accomplished by replacing the non-permanent bodies 26 with permanent magnets 126. These magnets 126 are oriented with respect to the permanent magnet 148 on the lever 142 so that the magnet 148 is moved upwardly every time it is opposite a magnet 126.

The lever 142 is also somewhat different in that the arms 152 are shaped so as to include bifurcated sub-arms 172 having opposed, parallel edges 174 which loosely engage the tone bar 158 across the nodal regions 160. These sub-arms 172 are slightly resilient and are provided with small ratchet-like retainers 176. These retainers 176 are shaped so that the tone bar 158 may be slipped between the sub-arms 172 so that notches 162 on the tone bar 158 fit generally over edges 156 located so as to extend between the sub-arms 172. When the tone bar 158 is so located it is held by the retainers 176 so that it cannot be dislodged from the lever 142. This tone bar 158 should be sufficiently light so that the magnet 148 is normally "low" and is held by the projection 168 so that it is spaced closely from the surface 116 by gravity under "normal" conditions.

The psychograph 100 also differs from the psychograph 10 in that in it a striker 170 is located on a small beam 178 extending across part of the frame 130 as shown so as to be located where the center of the tone bar 158 will hit it whenever the lever 142 is appropriately pivoted. This pivoting action is achieved in a manner reasonably related to the manner in which the arm 42 is rotated so as to produce a tone during the use of the planchette 14. Because the operation of the psychograph 100 is so similar to the operation of the psychograph 10 it is not considered necessary to discuss its operation in detail.

It is believed it will be obvious from the preceding description of the psychographs 10 and 100 that many changes can be made in the construction of these psychographs without departing from the concepts of the invention as set forth in the appended claims. The particular psychographs 10 and 100 are presently preferred structures in accordance with the invention for a number of reasons. A significant one of these reasons relates to the fact that the planchettes 14 and 114 used in the psychographs 10 and 100 are relatively flat, compact structures of such a character that they can be easily packaged along with the support members or boards 12 and 112.

In many respects the structure of a planchette as employed in a psychograph of this invention would be simplified by merely utilizing a magnet such as a magnet 48 which would be repelled by similar magnets on the support member or board used so as to directly actuate a sound producing member such as a tone bar 58 or 158 as described. Structures of this type are not, however, considered as desirable as the planchettes 14 and 114 previously indicated. Similarly, it would be possible to substitute a variety of different sound producing mechanisms for the tone bars 58 and 158 described. Such substitution is not considered desirable because these particular tone bars are comparatively simple, inexpensive sound producing structures which can be easily utilized in psychographs in accordance with this invention.

I claim:

1. A psychograph including a bottom member having an upper surface and a planchette capable of being moved relative to said upper surface in which the improvement comprises:

a plurality of indicia located on said upper surface of said bottom member, said indicia being spaced from one another, a magnetic means located on said planchette so as to be movable relative to said planchette, a plurality of other magnetic means capable of magnetic interaction with said magnetic means on said planchette each of said means capable of magnetic interaction being located adjacent to one of said indicia, each of said magnetic means capable of magnetic interaction being located on said bottom member, said planchette includes a viewing means for designating only a specific one of said indicia at any one time in accordance with the position of said planchette on said upper surface, said permanent magnet being located on said planchette in a position in which it will be moved in response to magnetic interaction with one of said other magnetic means when said planchette is in a position to designate a specific one of said indicia, at least one sound producing means located on said planchette for producing a sound in response to movement of said magnetic means on said planchette with respect to said planchette, at least one of said magnetic means comprising a permanent magnet, said position having a predetermined meaning which is associated only with the use of said psychograph.

2. A psychograph as claimed in claim 1 including:

a lever pivotally mounted on said planchette, said lever being operatively associated with said sound producing means so that movement of said lever actuates said sound producing means, said magnetic means on said planchette being located on said lever so that when said magnetic means on said planchette is located with respect to said magnetic means capable of magnetic interaction in a position to cause movement of said magnetic means on said planchette said lever is rotated so as to actuate said sound producing means.

3. A psychograph as claimed in claim 2 wherein:

said sound producing means is capable of being actuated by being struck and is located so as to be struck during movement of said lever as caused by magnetic interaction between said magnetic means capable of magnetic interaction and said magnetic means on said planchette.

4. A psychograph as claimed in claim 3 wherein:

said sound producing means is located on said lever and is struck by a part of said planchette when said lever is moved.

5. A psychograph as claimed in claims 2 or 4 wherein:

said permanent magnet is located on said lever so as to be drawn toward said top surface as a result of magnetic interaction with said means capable of magnetic interaction.

6. A psychograph as claimed in claims 1, 2 or 4 wherein:

both of said magnetic means are permanent magnets, said magnetic means are oriented so as to be capable of repelling one another.

7. A psychograph as claimed in claim 1 including:

a lever pivotally mounted on said planchette, said permanent magnet on said planchette is located on said lever so as to be moved said lever is moved, said sound producing means comprises a tone bar mounted on said lever so as to be moved when said lever is moved, striker means on said planchette for engaging said tone bar so as to actuate said tone bar when said permanent magnet and said lever are moved.

8. A psychograph as claimed in claim 7 wherein:

each of said magnetic means capable of magnetic interaction comprises a non-permanent magnet, ferro-magnetic member located on said bottom member, said lever is balanced so that said permanent magnet is capable of being moved toward said bottom member when said planchette is in a position to designate a specific one of said indicia.

9. A psychograph as claimed in claim 7 wherein:

said lever is balanced so that said permanent magnet is capable of being moved away from said upper surface of said bottom member by magnetic repulsion and, each of said magnetic means capable of magnetic interaction is a permanent magnet oriented so as to repel said permanent magnet on said planchette.

* * * * *